United States Patent [19]

Jeffery

[11] 4,017,084

[45] Apr. 12, 1977

[54] GOLF PUTTING AND CHIPPING DEVICE

[76] Inventor: Ernest Jeffery, 1 Liszt Gate No. 810, Willowdale, Ontario, Canada, M2H 1T6

[22] Filed: June 30, 1975

[21] Appl. No.: 591,516

[52] U.S. Cl. ..... 273/176 FB; 273/34 R; 273/177 R; 116/173; 273/DIG. 25

[51] Int. Cl.[2] ..... A63B 69/36; A63B 67/02

[58] Field of Search ..... 273/179, 195, 177, 34 R, 273/180, 178, 176 FB, 176 B, 181 A, 176 F, 176 FA, DIG. 25; 35/29 A

[56] References Cited

UNITED STATES PATENTS

| | | | |
|---|---|---|---|
| 3,048,405 | 8/1962 | McCaul | 273/177 R |
| 3,104,879 | 9/1963 | Jetton | 273/34 R X |
| 3,414,266 | 12/1968 | Mitchell | 273/195 A X |
| 3,464,704 | 9/1969 | Nelson | 273/180 X |
| 3,540,733 | 11/1970 | LaMattina | 273/179 A X |
| 3,633,917 | 1/1972 | Anderson | 273/195 A |

*Primary Examiner*—George J. Marlo
*Attorney, Agent, or Firm*—Joel Halpern

[57] ABSTRACT

A golf practice and amusement apparatus for golfers to practice chipping and putting. A receptacle is provided having a hollow inner compartment which contains a mounted roll of carpet. The upper exterior surface of the receptacle is given a central recessed portion. The carpet has an upper surface, when unwound and withdrawn from the receptacle, which presents a first area adjacent the free end of the carpet having a first degree of roughness and the balance of the upper surface having a lesser degree of roughness. A flag device formed of connected concentric strips and an upstanding flag connected to the center is positionable on the upper surface of the carpet. Suction cups may be provided on the receptacle, carpet, and flag device to anchor such elements in their use positions.

4 Claims, 4 Drawing Figures

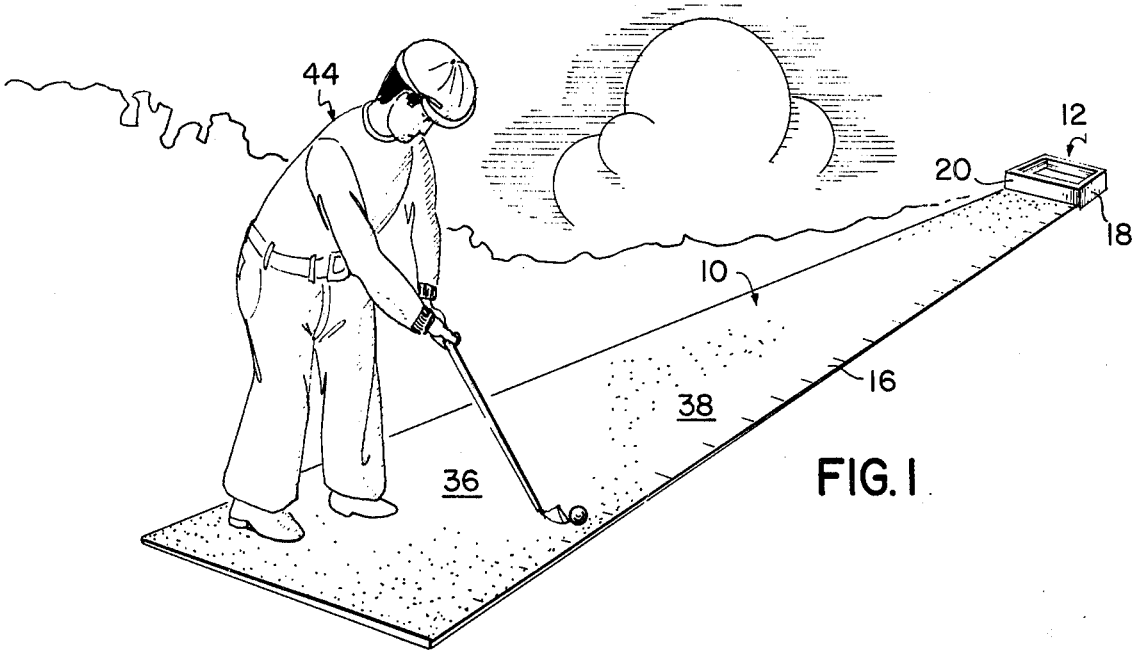
FIG. 1
FIG. 2
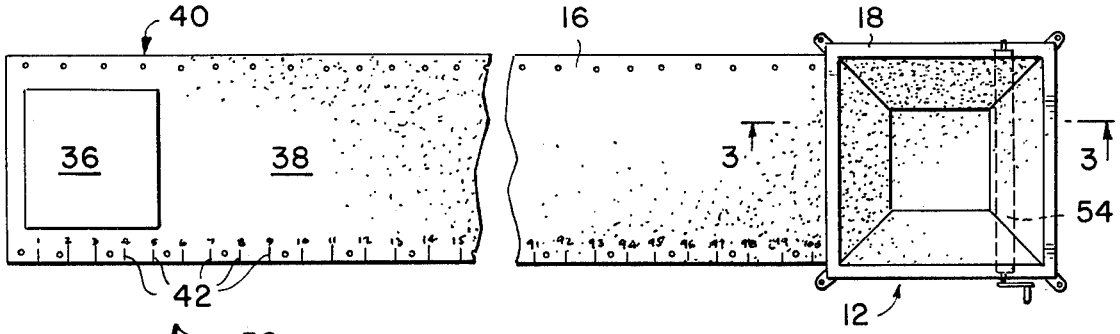
FIG. 4
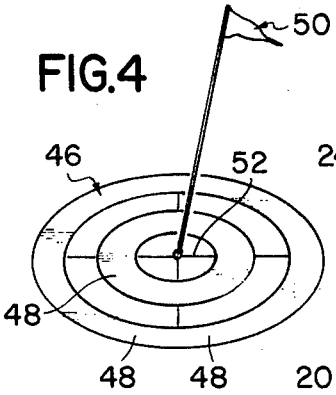
FIG. 3
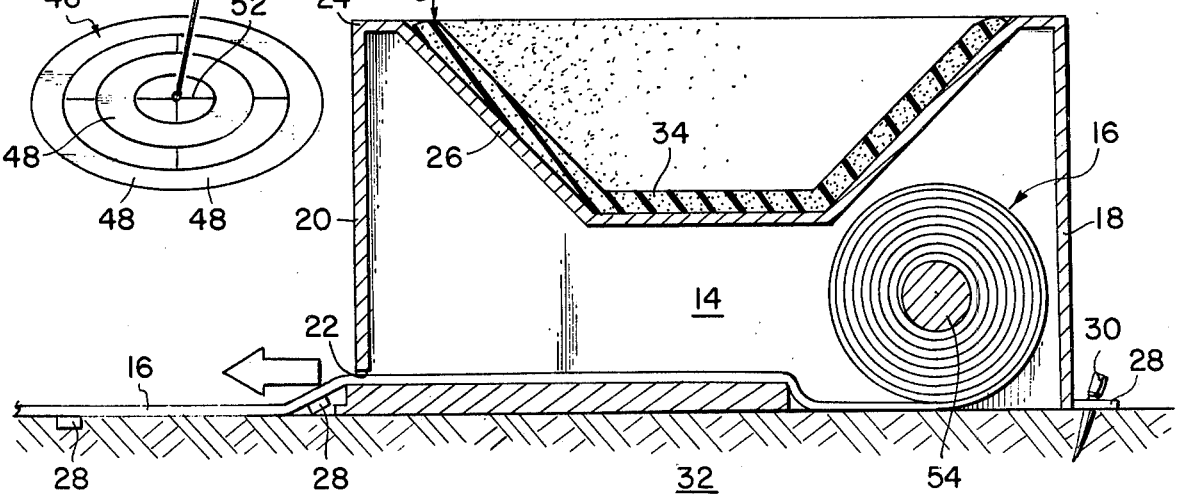

GOLF PUTTING AND CHIPPING DEVICE

SUMMARY OF THE INVENTION

It is one object of the invention to provide a golf practice and amusement apparatus which is portable and incorporates therein a carpet positionable to enable a player to practice chipping and/or putting.

It is another object of the invention to provide golf practice and amusement apparatus which simulates field conditions on an actual golf course so that the player can selectively practice from an area simulating the fairway of a golf course to improve his irons game or from an area where the fine putting green of a golf course is reproduced.

Other objects and advantages of the invention will become readily apparent from the ensuing description of the invention.

In accordance with the present invention there is provided in a golf practice and amusement apparatus enabling the player to practice both chipping and putting the combination of a receptacle having a hollow inner compartment and an upper wall provided with a central recessed cup-like portion, a roll of carpet mounted within said inner compartment, said receptacle being provided with a front wall in which there is located an aperture in the lower portion thereof dimensioned to permit the withdrawal of carpet therethrough, said carpet having an upper surface, when withdrawn from said receptacle, comprising a first area adjacent the free end thereof formed of a material offering a predetermined resistance to the movement of a golf ball thereacross and substantially the entire remaining upper surface formed of a material offering a lesser resistance to the movement of a golf ball thereacross.

BACKGROUND OF THE INVENTION

The invention relates to a golf practice and amusement apparatus and is particularly adapted to enable a player to utilize same to practice both chipping and putting.

Golf devices for use by players who wish to perfect their game through practice off the golf course have been known heretofore. Such devices have been portable and provide a putting surface having a cup. U.S. Pat. No. 3,843,136 issued Oct. 22, 1974 to Buenzle discloses one such device. U.S. Pat. No. 2,057,504 issued Oct. 13, 1956 to Schafer discloses another prior golf device in which a carpet, formed of felt or similar material on its upper portion to simulate the reaction to the rolling of a golf ball thereon, may be wound upon a roller and stored within a framework. However, no prior art device has been so constructed as to enable a player to practice both chipping and putting from surfaces which simulate actual field or golf course conditions. Prior devices have been deficient in this regard since the surfaces provided have been uniform throughout.

BRIEF DESCRIPTION OF THE DRAWINGS

In order that the invention may be more fully understood it will now be described, by way of example, with reference to the accompanying drawings in which:

FIG. 1 is a perspective view of a player positioned on the apparatus of the invention practicing chipping;

FIG. 2 is a top plan view, partially broken, of the apparatus shown in FIG. 1;

FIG. 3 is a side elevation view partly in section, taken along line 3—3 of FIG. 2 of the receptacle of the invention with the carpet mounted therein; and FIG. 4 is a perspective view of a flag device in accordance with the invention utilizable in conjunction with the carpet.

DETAILED DESCRIPTION OF THE INVENTION

Referring to the drawings there is shown a golf practice and amusement apparatus 10. The apparatus includes a receptacle 12 which may be formed in any selected shape and from any rigid material such as metal, plastics or a heavy cardboard. The receptacle is constructed so as to have a hollow inner compartment 14 so that a carpet 16, to be hereinafter described, may be mounted therein and rolled up for storage. The receptacle is desirably formed with side walls 18 and with a front wall 20 in which there is located an aperture 22 in the lower portion thereof. The aperture is dimensioned so as to permit the withdrawal therethrough of carpet 16 as depicted in FIG. 3. The receptacle is provided with an upper wall 24 which is dished towards its center to form a central recessed cup-like portion 26 for a purpose to be subsequently described. Desirably the surface of the recessed portion is lined with a resilient material 34 such as sponge rubber to minimize noise when this region of the receptacle is struck with a golf ball and also to reduce the possibility of damage to the receptacle and/or the golf ball.

The base or bottom of the receptacle may be provided with means 28 for securing same in a fixed location. In similar manner the bottom surface of the carpet 16 is preferably provided with securing means 28. Such securing means may taken the form of a suction cup or, as shown in FIG. 3, the bottom of the receptacle may have joined to selected edges a flange through which a peg 30 may be driven if the apparatus is to be employed outdoors. In such event the peg can be driven into the ground 32.

Carpet 16 is formed with a material which, when withdrawn from the receptacle, presents an upper surface comprising a first area 36 located adjacent the free end of the carpet which offers a predetermined resistance to the movement of a golf ball thereacross. This area is intended for use in the practice of chip shots into the cup-like portion 26 of the receptacle. Therefore, the upper surface of the carpet in this region should be rough relative to the remainder of the upper surface 38 of the carpet. Substantially the entire remaining area 38 is formed of a material which offers a lesser resistance to the movement of a golf ball thereacross. Desirably area 38 should be smooth so as to resemble the close-cropped, fine almost velvet-like surface of the putting green of a golf course. It will be appreciated that any of the synthetic fibers customarily used in athletic stadia such as for football fields may be utilized or the area 38 may be formed from a "Tartan" surface or the like such as manufactured by Minnesota Mining and Manufacturing Co. of Minnesota. The area 36, however, will have a rougher texture so as to simulate the fairway of a golf course.

In order to duplicate the varying topographical surfaces of an actual golf course sections of the carpet may be brushed in any desired direction, for example towards or away from the flag accessory device to be described hereafter. Different speeds for putting or chipping can also be provided by dampening of the surface. By increasing the surface moisture the rolling speed may be reduced.

The carpet is provided at either or both of its longitudinally extending edges or boundaries 40 with indicia 42 which indicates the length of carpet withdrawn from the receptacle 12. Thus, a player 44 may withdraw a length of carpet from the receptacle and will position himself either on area 36 or on area 38 depending upon whether he desires to practice chip shots or putting. When positioned upon area 36 he may employ an iron such as a 5, 7 or 9 iron and he will attempt to chip onto the receptacle. Alternatively he may employ a flag accessory device 46 which can be placed upon the carpet in the vicinity of the receptacle. The flag device is made with a series of connected concentric strips 48. A flag 50 is secured at its base to the center of the material so as to stand upright as a target for the player. The strips have a preselected width gauged to enable the player to measure the distance from the center of the device where the ball stops. The strips may be approximately 6 inches in width. Thus, the concentric strips will serve as a guide for the player to determine the accuracy of his chip shot. It will be understood that the flag device can also be utilized in connection with putting practice in the same manner. Preferably the flag is connected to the concentric strips by means of fine wires 52 which are secured to the strips. The bottom of the flag device is desirably provided with means such as a suction cup for retaining the device in fixed position relative to the carpet.

The carpet may be mounted within the receptacle in any convenient manner such as by means of a roller 54 which extends transversely across the receptacle and is journaled in the side walls thereof. The roller can be spring loaded for an automatic rewinding of the carpet thereon when desired or a handle can be secured to the roller to rewind the carpet when the apparatus is to be stored. One of the walls of the receptacle should be so constructed as to either pivotable or removable to permit access to the interior compartment in order to facilitate maintenance or replacement of the roller and/or carpet when required.

What is claimed is:

1. In a golf practice and amusement device enabling a player to practice both chipping and putting the combination of a receptacle including side, front and upper walls defining an inner compartment, said upper wall being dished to present a central recessed cup-like portion occupying the major area thereof, a roll of carpet mounted rotatably within said inner compartment, a transversely extending aperture formed in the lower portion of said front wall dimensioned to permit the withdrawal of said carpet therethrough, said carpet having an upper surface, when withdrawn from said receptacle, comprising a first area adjacent the free end thereof formed of a material offering a predetermined resistance to the movement of a golf ball thereacross and substantially the entire remaining upper surface formed of a material offering a lesser resistance to the movement of a golf ball thereacross.

2. A golf practice and amusement apparatus according to claim 1, wherein the bottom of said receptacle is provided with at least one suction cup and the bottom surface of said carpet, when withdrawn from said receptacle, is provided with a plurality of suction cups.

3. A golf practice and amusement apparatus according to claim 1, wherein said carpet is provided on the said upper surface with indicia indicative of the linear distance said carpet has been withdrawn from said receptacle.

4. A golf practice and amusement apparatus according to claim 1, wherein a flag accessory device is provided, said device including a series of concentrically arranged connected planar strips of a solid material, an upstanding flag being secured to the center of said material, said device being positionable upon the upper surface of said carpet in fixed relation thereto by means of a suction cup secured to the bottom surface of said device.

* * * * *